US005956807A

United States Patent [19]

Kuo

[11] Patent Number: 5,956,807

[45] Date of Patent: Sep. 28, 1999

[54] RETRACTABLE PULL-HANDLE ASSEMBLY

[75] Inventor: Chung-Hsien Kuo, Taipei, Taiwan

[73] Assignee: Chaw Khong Technology Co. Ltd., Taipei, Taiwan

[21] Appl. No.: 09/001,493

[22] Filed: Dec. 31, 1997

[51] Int. Cl.[6] ..... A47B 95/02

[52] U.S. Cl. ..... 16/115; 280/655

[58] Field of Search ..... 16/115; 190/15.1, 190/18 A, 115; 280/655, 655.1, 47.315

[56] References Cited

U.S. PATENT DOCUMENTS

| | | | |
|---|---|---|---|
| 4,508,202 | 4/1985 | Siegert et al. | 16/115 |
| 5,322,334 | 6/1994 | Hammer | 16/115 |
| 5,500,981 | 3/1996 | Ho | 16/115 |
| 5,535,483 | 7/1996 | Cabagnero | 16/115 |
| 5,692,266 | 12/1997 | Tsai | 16/115 |

*Primary Examiner*—Chuck Y. Mah
*Attorney, Agent, or Firm*—Tung & Associates

[57] ABSTRACT

The present invention provides a retractable pull-handle system that utilizes a unique flexible control cable for the remote control of a locking/unlocking of an inner sliding tube and an outer support tube from a push-button installed in a handle grip such that when the push-button is pressed downwardly, the pull-handle system can be easily extended for use or retracted in a storage position. The present invention novel flexible control cable allows the use of substantially non-linear handle grip designs and particularly those designed ergonomically for reducing operating stress to a human hand.

7 Claims, 2 Drawing Sheets

RETRACTABLE PULL-HANDLE ASSEMBLY

FIELD OF THE INVENTION

The present invention generally relates to a retractable pull-handle assembly for the attaching to and the pulling of a wheeled article and more particularly, relates to a retractable pull-handle assembly for the attaching to and the pulling of a wheeled luggage by utilizing a flexible steel cable that is connected to a push-button mounted in the pull-handle for the operation of locking/unlocking of an inner tube to an outer tube of the pull-handle assembly.

BACKGROUND OF THE INVENTION

Wheeled luggage has been popularly used in recent years by travelers in various forms of transportation. When designing a wheeled luggage, a number of important criteria of the luggage must be satisfied. For instance, the luggage should be rigidly constructed for surviving rough handling when pulled in the streets, in and out of buildings with ascending or descending steps, and in and out of various forms of carriers such as airplanes or motor vehicles. The wheeled luggage must also have adequate wheel means such that a luggage can be pulled along on a pavement with relative ease. The wheeled luggage should also have a convenient pull-handle system that can be easily stowed away when not in use and extended when needed.

One difficulty frequently encountered in using a wheeled luggage is the lack of a reliable pull-handle system that can be used for locking or unlocking a handle so that a handle can be retracted for storage or extended for use. The lack of a reliable and easy to use handle locking/unlocking mechanism presents serious problems and great inconveniences in the use of a wheeled luggage. For instance, when a luggage is positioned sideways or in an upside-down position, the gravity of the handle may cause the accidentally extension of the handle and cause problems to a luggage conveyor belt. As a result, serious damages can occur to the luggage or to the conveyor system. Efforts have been made by others to remedy the problems. For instance, in U.S. Pat. No. 5,526, 908, a retractable handle assembly which can be easily expanded and folded without exerting a large force thereon. The retractable handle assembly includes a hollow bracket mounted on a top plate of one of the half bodies thereof, a pair of lug portions each formed on one of the distal end portions of the bracket and each having a first bore laterally defined therein, a pair of outer tubes each securely mounted between the lug portion and a bottom plate of the half body and each having a second bore laterally defined therein for aligning with the first bore, the pair of inner tubes each is slidably mounted in one of the outer tubes and each having a third bore laterally defined therein for aligning with the second bore, a substantially U-shaped handle portion mounted on the bracket and having two free end portions each engaged with the upper end of a corresponding one of the inner tubes, a pressing member movably mounted in a hollow bracket and including a knob extending through an opening of the hollow bracket, a biasing member mounted on an underside of the present member and including a pair of stubs each respectively extending through the first bore of associated lug portion, the second bore of associated outer tube and the third bore of associated inner tube.

In another issued U.S. Pat. No. 5,499,426, a handle device is disclosed which includes a pair of storage tubes adapted to be mounted on a rear face of a wheeled suitcase, a seat frame, a handle member and a locking mechanism. The locking mechanism is provided in the receiving space of the seat frame and includes two projecting members, a biasing unit between the projecting members for biasing the projection members toward the storage tubes and for locking the handle member relative to the storage tubes when the two engaging holes are in alignment, and a retracting unit for retracting the projecting members to release the handle member relative to the storage tubes. U.S. Pat. No. 5,431, 428 discloses a carrying case assembly that is equipped with a collapsible handle assembly disposed within the case, the handle assembly includes a push button which allows the handle to collapse within the case. The handle assembly further includes a lock means for holding the first handle portion in an extended position relative to the second handle portion, the handle lock means includes a selectably releasable handle-locking protrusions on one of the first and second handle portions, movable in opposing directions toward and away from the other of the first and second handle portions into and out of engagement therewith. In still another issued patent, U.S. Pat. No. 5,502,876 a pull handle for a trunk is disclosed which includes a pair of driving rods each having a wedge member disposed at the bottom end thereof and is in abutment with a spring biased locking seat having an oblique cam surface. Each driving rod is housed in a hollow tube and the locking seat is in selective engagement with one of a plurality of spaced retaining slots disposed on a movable sleeve which accommodates each hollow tube.

A conventional pull-handle assembly that is retractable and extendable is shown in FIG. 1. A pull-handle system 10 is constructed by a U-shaped handle assembly 14 and a pair of parallelly extended support tubes 12. In each of the support tube 12, there is a tubular shaped opening 16 and an aperture 18 for engaging to a locking pin 28. The U-shaped handle assembly 14 includes a handle grip 20 and a pair of sliding tubes 22 affixed to the two opposite ends of the handle grip 20. At the bottom end of the sliding tube 22, a latching device 24 is attached. The latching device 24 is equipped with a locking pin 28 for engaging the aperture 18 provided at or near the upper end of the support tube 12. A push-button 26 is installed in the handle grip 20 through an aperture 25. This is shown in FIG. 2. The push-button 26 is used to control the latching device 24 on the sliding tube 22 for locking or unlocking the sliding tube 22 to the support tube 12.

The sliding tube 22 is inserted into the tubular opening 16 in the support tube 12 at its free end, i.e., opposite to the end that is affixed to the handle grip 20, such that it may slide freely inside the tubular opening 16. At the lower extremity of the sliding tube 22, a latching device 24 is provided which is equipped with a retractable locking pin 28 for engaging with the aperture 18 provided in the support tube 12 such that an extended position of the retractable pull-handle can be secured. At the lower end (not shown) of the support tube 12, another aperture (not shown) is provided for engaging retractable locking pin 28 when the sliding tube 22 is fully inserted into the support tube 12 and thus locking the two tubes in a stowed away position when the pull-handle is not needed. When the push-button 26 is pressed downwardly, the retractable locking pin 28 on the latching device 24 at the tip of the sliding tube 22 is retracted inwardly such that the sliding tube 22 unlocks itself from the support tube 12 to enable the sliding tube 22 to slide freely in the tubular opening 16 ofthe support tube 12.

FIG. 2 shows a cross-sectional view of the pull-handle assembly 14 taken along line 2—2 of FIG. 1. FIG. 2 shows that inside the pull-handle assembly 14, each one of the two sliding tube 22 has a tubular opening 30 therein. Within the handle grip 20, there is provided an interior chamber 32 which is open to the tubular openings 30 in the two sliding tubes 22. The push-button 26 is positioned at the center of the chamber 32. Each of the latching device 24 on the sliding tube 22 is equipped with a latch hook 38 positioned at the top of the latching device 24 and a retractable locking pin 28 positioned on the inside of the latching device 24.

On both sides of the push-button 26, there is provided a cantilevered arm 33 for controlling the latching device 24 at the lower extremity of the two sliding tubes 22. The cantilever arm 33 is fixed at a pivoting point 34 such that the two ends of the cantilever arm 36, 37 may move freely up and down. A rigid control rod 36 is positioned inside the tubular opening 30 of the sliding tube 22 and hooked onto a notch 35 provided at the outer end 36 of the cantilever arm 33. The lower end of the rigid control rod 36 is attached to the latch hook 38 to allow the operation of the locking pin 28 from an extended position to a retracted position when the rod 36 is pulled up by the cantilevered arm 33. The inner end 37 of the cantilever arm 33 is positioned directly under the push-button 26 such that when the push-button 26 is pressed downwardly, the inner end 37 of the cantilever arm 33 is pushed downwardly. The cantilever arm 33 thus pivots at the pivoting point 34 and causing the outer end 36 of the arm 33 to move upward. The rigid control rod 36 is thus pulled up together with the latch hook attached to the latching device 24. The locking pin 28 is retracted as a result from the aperture 18 to free the inner tube 22 from locking to the support tube 12. This allows the free movement of the sliding tube 22 inside the tubular opening 16 of the support tube 12.

Numerous problems in the construction and the operation of the conventional pullhandle system shown in FIGS. 1 and 2 are encountered. The pull-handle system 10 utilizes a cantilever arm 33 and a rigid control rod 36 for achieving the locking/unlocking functions of the inner tube 22 to the support tube 12. Even though the mechanism is relatively simple, the bulky volume of the cantilever arm 33 and the large volume of space it requires when pivoting around the pivoting point 34 making it impossible for a more compact handle grip 20 to be designed. Moreover, since neither the cantilever arm 33 nor the rigid control rod 36 is flexible, the structure cannot be utilized in a non-linear handle grip configuration. For instance, the structure cannot be easily adapted to the modern ergonomically designed handle grips which are normally more curved than a conventional handle grip.

It is therefore an object of the present invention to provide a retractable pull-handle system that does not have the drawbacks or the shortcomings of the conventional pull-handle systems.

It is another object of the present invention to provide a retractable pull-handle system that does not require the use of rigid cantilever arms and control rods for engaging and disengaging a handle locking mechanism.

It is a further object of the present invention to provide a retractable pull-handle system that utilizes a flexible steel cable for operating a locking/unlocking system by the simple operation of a push-button.

It is another further object of the present invention to provide a retractable pull-handle system that can be advantageously used on a wheeled luggage.

It is still another object of the present invention to provide a retractable pull-handle system that utilizes a braided flexible cable for operating a handle locking/unlocking system.

It is yet another object of the present invention to provide a retractable pull-handle system for use on a wheeled luggage for operating the retraction/extension of an inner sliding tube in an outer support tube.

It is yet another further object of the present invention to provide a retractable pull-handle system for use on a wheeled luggage by utilizing a push-button that has a pair of inclined surfaces for engaging a pair of sliding blocks having correspondingly inclined surfaces for operating the locking/unlocking of the pull-handle through a flexible metal cable.

SUMMARY OF THE INVENTION

In accordance with the present invention, a retractable pull-handle system is provided which can be used on any wheeled articles that are pullable but is particularly suitable for use on a wheeled luggage. The pull-handle system utilizes a flexible metal cable for the transmission of a locking/unlocking command from a push-button located in a handle grip to a pair of inner and outer tubes for achieving the extension or the retraction of the pull-handle system.

In a preferred embodiment, a retractable pull-handle system is provided which includes a pair of parallelly positioned and spaced apart support tubes, each of the tubes has an open upper end and an interior cavity adapted for accepting a sliding tube to slide freely therein and a lower end for fixing to a wheeled article to be pulled, and a U-shaped handle assembly which includes a handle grip and two sliding tubes spaced apart in a parallel relationship each having a fixed end affixed to the handle grip and a free end slidingly engaging the interior cavity of the support tube, the handle grip has a cavity/aperture therein for accepting a push-button adapted for engaging or disengaging a locking means associated with each of the sliding tubes for locking or unlocking the sliding tube to the support tube, the locking means includes a flexible cable.

The locking means used in the preferred embodiment of the present invention may further include a pair of sliding blocks situated in the cavity of the handle grip that is capable of making longitudinal movements in the grip, each of the blocks has on one end an inclined top surface facing and mirror imaged to each other and a means for attaching to a flexible cable at the opposite end, a push-button that has a pair of inclined surfaces on its bottom face adapted for engaging the inclined surfaces on the sliding blocks such that when the push-button is pressed downwardly, the pair of inclined surfaces on the push-button engages the inclined surfaces on the sliding blocks and thereby pushing the blocks toward each other and consequently pulling the pair of flexible cables toward the push-button, and a latching device affixed to the free end of each sliding tube, the latching device is equipped with a locking pin adapted to engage an aperture provided at the upper end of the support tube such that the sliding tube and the support tube are engaged in a fully extended position when the pin engages the apertures, the latching device is further equipped with means for affixing to one end of the flexible cable such that when the cable is pulled toward the push-button, the locking pin disengages from the aperture and thus allowing the sliding tube to move freely inside the support tube. A suitable flexible cable used is a flexible steel cable, or a braided flexible steel cable.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a retractable pull-handle system that can be used on any wheeled articles that can be pulled but is particularly suitable for use on a wheeled luggage for locking and unlocking of a retractable pull-handle. The present invention pull-handle system utilizes a unique flexible metal cable arrangement for transmitting an unlocking action from a push-button located in a handle grip to a latch mechanism located in the inner tubes in a inner tube/outer tube arrangement.

Figure 3:
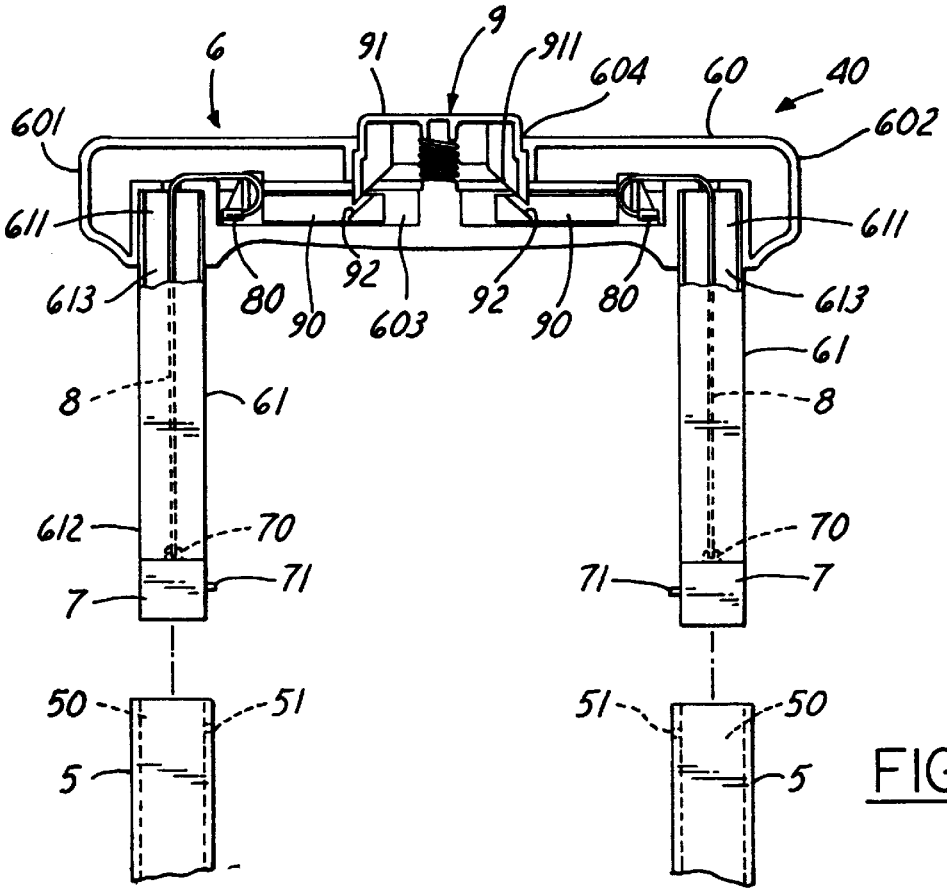
FIG. 3 is a cross-sectional view of a present invention pull-handle assembly illustrating the flexible cable arrangement for operating the locking/unlocking mechanism.

Referring now to FIG. 3, where it is shown a cross-sectional view of the present invention retractable pull-handle system 40. The retractable pull-handle system 40 includes two parallelly arranged, spaced apart support tubes 5, a U-shaped handle grip 6, two sliding tubes 61 and latching devices 7 two flexible cable 8 and an unlocking device 9. In each of the support tube 5, there is a tubular internal opening 50 and an aperture 51 at near the top of the support tube 5. The U-shaped handle grip assembly 6 includes a handle grip 60 and two sliding tubes 61. The handle grip 60 is generally provided in an elongated form having two end portions 601 and 602. Each one of the sliding tube 61 includes an upper end 611 and a lower end 612. Each of the upper ends 611 of the sliding tubes 61 is fixed to the end portions 601 and 602 of the handle grip 60. The lower ends 612 of the two sliding tubes 61 are inserted into the tubular openings 50 of the two support tubes 51 and are allowed to slide freely in the tubular openings 50. At the upper end of the sliding tubes 61, there is an opening 613 which is open to the interior chamber 603 of the handle grip 60. This provides an open passageway for the flexible control cable 8 to go through the interior chamber 603 and the opening 613 such that it can be connected to the latching device 7 at the latch hook 70. This provides the connection to and, subsequently the control of the latching device 7 by the sliding blocks 90. The interior chamber 603 provided in the handle grip 60 further opens through the top of the handle grip in an aperture 604. The aperture 604 allows the installation of a push-button 91 in the interior chamber 603 in the handle grip 60.

Figure 4:
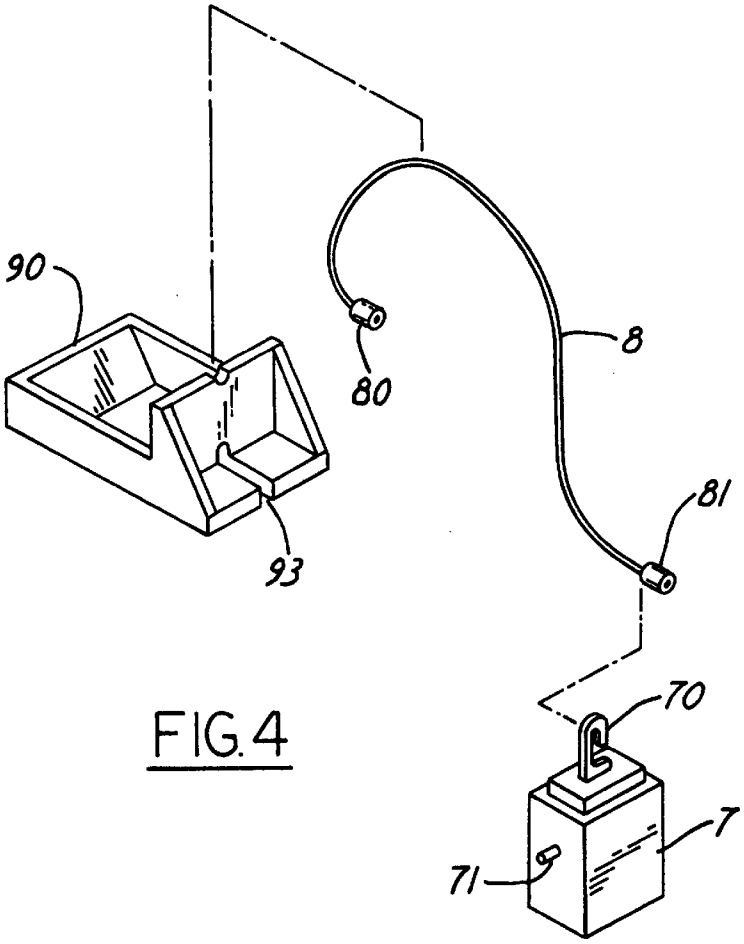
FIG. 4 is a perspective view of the present invention sliding block and the latching device that are connected by a flexible metal cable.
Figure 1:
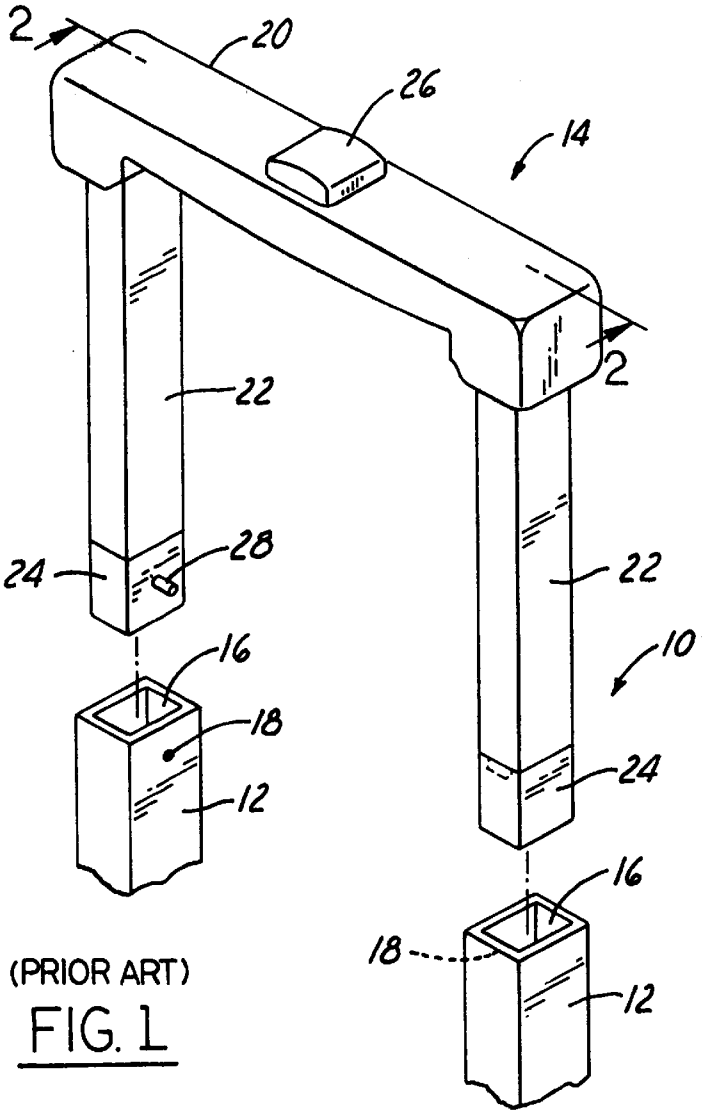
(PRIOR ART) FIG. 1
FIG. 1 is a perspective view of a conventional pull-handle assembly utilizing a cantilever arm and a rigid control rod for the unlocking of a sliding inner tube to an outer tube.
Figure 2:
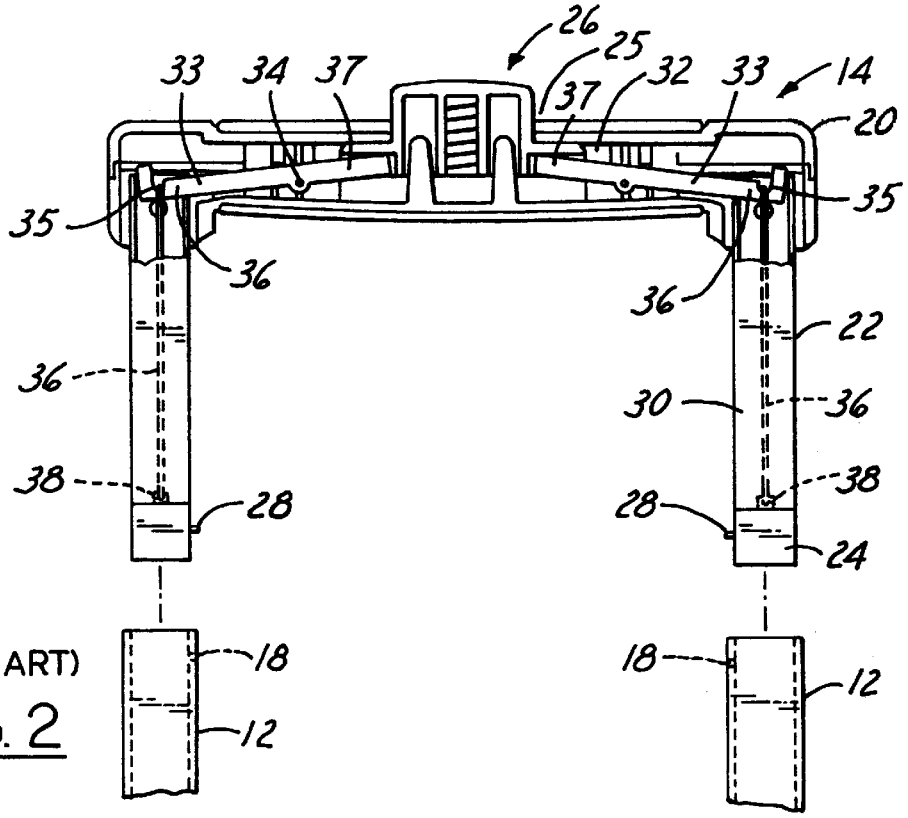
(PRIOR ART) FIG. 2
FIG. 2 is a cross-sectional view taken along line 2—2 of FIG. 1 showing the internal mechanism in the pull-handle assembly.

The latching devices 7 are each affixed to the lower end of the two sliding tubes 61. The latching devices 7 are used to engage with apertures 51 in the support tubes 5 through locking pins 71 mounted on the side of the latching devices 7. The engagement of a locking pin 71 with an aperture 51 allows the locking of the inner tube 61 to the support tube 5 such that the two tubes are fixed in a fully extended position. At such a fully extended position, the wheeled luggage (not shown) can be easily pulled or pushed by the handle grip 60. Each of the two latching devices 7 is equipped with a latching hook 70 positioned on top of the latching device for connecting to the lower end of the flexible control cable 8. A detailed, enlarged perspective view of the latching device 7, the sliding block 90 and the flexible control cable 8 are shown in FIG. 4.

When the latching hook 70 is pulled up by the flexible control cable 8 through the engagement of an end cap 81 on the cable 8 with the hook 70, the locking pin 71 on the latching device 70 is pulled back into a retracted position such that the latching device 7 separates from the aperture 5 1 of the support tube 5. The disengagement between the locking pin 71 and the aperture 51 allows the sliding tubes 61 to slide freely inside the support tube 5. A stop (not shown) is normally provided at the upper end of the support tube 5 such that the inner tube 61 cannot be pulled all the way out of the support tube 5. The end cap 80 and 81 are used to cap the flexible control cable 8 at its two ends. They not only serve the function of providing an easy connection to the latching hook 70 and the sliding block 90 through a slot opening 93, but also provide the function of protecting the ends of the flexible cable 8 from being damaged in use. They further provide the function of protecting the flexible cable from separating when the cable is a braided cable.

The unlocking device 9 is installed in the interior chamber 603 in the handle grip 60 through the aperture 604. The unlocking device 9 consists of two sliding blocks 90 and a push-button 91. The two sliding blocks 90 are positioned in the interior chamber 603 of the handle grip 60 in such away that they are allowed to slide in a horizontal direction. On top of each of the sliding blocks 90, there is equipped an inclined surface 92 at one end of the sliding block toward the push-button 91. At the other end of the sliding block 90, a slot opening 93 (see FIG. 4) is provided adapted for connecting to an end cap 80 of the flexible cable 8.

The push-button 91 is positioned in the opening 604 for allowing the vertical movement of the push-button. On the lower face of the push-button 94, two inclined surfaces 911 are provided. When the push-button 94 is pressed downwardly, the two inclined surfaces 911 on its bottom face engages the two inclined surfaces 92 on the two sliding blocks 90 such that the two sliding blocks 90 are pulled toward the center. As a consequence, the end caps 80 of the flexible control cable 8 is also pulled toward the center of the handle grip 60. The movement of the flexible control cable 8 toward the center of the handle grip 60 allows the latch hook 70 to be pulled up to retract the locking pins 71 and to unlock the sliding tube 61 from the support tube 5.

FIG. 4 shows a detailed perspective view of the flexible control cable 8, the sliding block 90 and the latching device 7. The flexible control cable 8 can be any flexible control cable and most suitably, can be a cable braided together by a number of thin steel wires. The two ends of the control cable 8 are each capped by an end cap 80 and 81 to tie the thin steel wires together and to prevent the cable from falling apart. The upper end 80 of the flexible control cable 8 is attached to the slot opening 93 in the sliding block 90. The lower end 81 of the flexible control cable 8 is attached to the latch hook 70 on top of the latching device 7.

The present invention advantageous method is made possible by the use of a flexible control cable which has a suitable flexibility and a minimal extensibility. The flexible cable 8 can be used to easily pass through the interior chamber 603 of the handle grip 60 and the opening 613 in the sliding tube 61 for attaching to and pulling the latch hook 70 on top of the latching device 7. The flexibility of the control cable 8 makes it possible for installation in a substantially non-linear handle grip and sliding tubes, i.e., those designed ergonomically for minimizing the operational stress on a human hand. This is a significant benefit only made possible by the present invention apparatus that was not previously achievable in the conventional pull-handle systems. Furthermore, when compared to a cantilevered arm arrangement used in the conventional pull-handle assembly, a flexible control cable is substantially smaller in size and as a consequence, requires a substantially smaller space for its operation when compared to the conventional cantilevered arm. The present invention novel pull-handle system further provides the benefit of being able to be easily assembled together in an assembling process.

The present invention novel retractable pull-handle system has therefore been amply demonstrated the above descriptions and FIGS. 3 and 4. It should be noted that while a wheeled luggage is used as an implementation example of the present invention novel pull-handle system, the present invention system is by no means limited to such luggage applications. The present invention novel pull-handle system can therefore be utilized on any pullable articles that are preferably on wheels.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. A retractable pull-handle system comprising:

a pair of parallelly positioned and spaced apart support tubes, each of said tubes having an open upper end and an interior cavity adapted for accepting a sliding tube to slide freely therein and a lower end for fixing to an article to be pulled, and a U-shaped handle assembly comprises a handle grip and two sliding tubes positioned spaced apart in a parallel relationship each having an end affixed to the handle grip and a free end slidingly engaging the interior cavity of the support tube, said handle grip comprises a cavity therein, a push-button and a locking means, said push-button adapted for engaging or dis-engaging said locking means associated with each of said sliding tubes for locking or unlocking said sliding tube to said support tube, said locking means comprises a flexible cable, a pair of sliding blocks situated in the cavity of the handle grip making longitudinal movements in said grip, each of said blocks having at one end an inclined top surface and a means for attaching to said flexible cable at the opposite end, said push-button having a pair of inclined surfaces on its bottom face adapted for engaging the inclined surface on said sliding blocks such that when the push-button is pressed downwardly, the pair of inclined surfaces on the push-button engages the inclined surfaces on the sliding block and thereby pushing the blocks toward each other and subsequently pulling the pair of flexible cables toward the push-button, and a latch affixed to the free end of each sliding tube, said latch equipped with a locking pin adapted to engage an aperture provided at an upper end of the support tube such that the sliding tube and the support tube are engaged in a fully extended position when said pin engages said aperture, said latch further equipped with means for affixing to one end of the flexible cable such that when the cable is pulled toward the push-button, the locking pin disengages from the aperture and thus allowing the sliding tube to move freely inside the support tube.

2. A retractable pull-handle assembly according to claim 1, wherein said flexible cable is a flexible steel cable.

3. A retractable pull-handle assembly according to claim 1, wherein said flexible cable is braided together by a plurality of thin metal wires.

4. A retractable pull-handle assembly according to claim 1, wherein said flexible cable has two free ends, and each free end is capped by an end-cap.

5. A retractable pull-handle assembly according to claim 1, wherein said attaching means of each of said sliding blocks is equipped with a slot opening for engaging an end-cap provided on said flexible cable.

6. A retractable pull-handle assembly according to claim 1, wherein said sliding tube and said support tube have an annular cross-section.

7. A retractable pull-handle assembly according to claim 1, wherein said sliding tube and said support tube have a rectangular cross-section.

* * * * *